US008507425B2

(12) United States Patent
Schick et al.

(10) Patent No.: US 8,507,425 B2
(45) Date of Patent: Aug. 13, 2013

(54) PARTICULATE FABRIC SOFTENER COMPRISING ETHYLENEDIAMINE FATTY ACID AMIDES AND METHOD OF MAKING

(75) Inventors: Georg Schick, Krefeld (DE); Lee R. Harrison, Moseley, VA (US); Kevin Murphy, San Ramon, CA (US)

(73) Assignee: Evonik Degussa GmbH, Essen (DE)

( * ) Notice: Subject to any disclaimer, the term of this patent is extended or adjusted under 35 U.S.C. 154(b) by 113 days.

(21) Appl. No.: 13/168,958

(22) Filed: Jun. 25, 2011

(65) Prior Publication Data

US 2012/0088712 A1 Apr. 12, 2012

Related U.S. Application Data

(60) Provisional application No. 61/359,660, filed on Jun. 29, 2010.

(51) Int. Cl.
*C11D 1/62* (2006.01)
*C11D 1/645* (2006.01)

(52) U.S. Cl.
USPC ..... 510/515; 510/276; 510/322; 510/327; 510/329; 510/330; 510/437; 510/501; 510/504; 510/519

(58) Field of Classification Search
USPC ..... 510/276, 322, 327, 329, 330, 437, 510/501, 504, 515, 519
See application file for complete search history.

(56) References Cited

U.S. PATENT DOCUMENTS

| | | | | |
|---|---|---|---|---|
| 4,234,627 | A | 11/1980 | Schilling | |
| 4,514,461 | A | 4/1985 | Woo | |
| 4,747,880 | A | 5/1988 | Berrido et al. | |
| RE32,713 | E | 7/1988 | Woo | |
| 4,789,491 | A | 12/1988 | Chang et al. | |
| 4,882,220 | A | 11/1989 | Ono et al. | |
| 4,917,920 | A | 4/1990 | Ono et al. | |
| 4,954,285 | A * | 9/1990 | Wierenga et al. | 510/101 |
| 5,002,681 | A * | 3/1991 | Wierenga et al. | 510/297 |
| 5,137,646 | A | 8/1992 | Schmidt et al. | |
| 5,391,325 | A | 2/1995 | Swenson et al. | |
| 5,480,567 | A | 1/1996 | Lam et al. | |
| 5,703,029 | A | 12/1997 | Crass et al. | |
| 5,759,990 | A | 6/1998 | Wahl et al. | |
| 5,792,219 | A | 8/1998 | Hartman et al. | |
| 5,827,451 | A | 10/1998 | Cummings et al. | |
| 6,180,593 | B1 | 1/2001 | Fender et al. | |
| 6,200,949 | B1 | 3/2001 | Reijmer et al. | |
| 6,235,914 | B1 | 5/2001 | Steiger et al. | |
| 6,255,274 | B1 | 7/2001 | Becherer et al. | |
| 6,376,455 | B1 | 4/2002 | Friedli et al. | |
| 6,458,343 | B1 | 10/2002 | Zeman et al. | |
| 6,492,322 | B1 | 12/2002 | Cooper et al. | |
| 6,608,024 | B1 | 8/2003 | DuVal et al. | |
| 6,645,479 | B1 | 11/2003 | Shefer et al. | |
| 6,653,275 | B1 | 11/2003 | Fender et al. | |
| 6,770,608 | B2 | 8/2004 | Franklin et al. | |
| 6,897,194 | B2 | 5/2005 | Fan et al. | |
| 6,987,074 | B2 | 1/2006 | Ishii et al. | |
| 7,572,761 | B2 | 8/2009 | Gefvert | |
| 7,704,940 | B2 | 4/2010 | Boerefijn et al. | |
| 7,994,110 | B2 | 8/2011 | Wenk et al. | |
| 8,183,199 | B2 | 5/2012 | Fossum et al. | |
| 2003/0060390 | A1 | 3/2003 | Demeyere et al. | |
| 2003/0158344 | A1 | 8/2003 | Rodriques et al. | |
| 2003/0165692 | A1 | 9/2003 | Koch et al. | |
| 2003/0195130 | A1 | 10/2003 | Lentsch et al. | |
| 2003/0195133 | A1 | 10/2003 | Shefer et al. | |
| 2003/0203829 | A1 | 10/2003 | Shefer et al. | |
| 2003/0215417 | A1 | 11/2003 | Uchiyama et al. | |
| 2003/0216282 | A1 | 11/2003 | Martens et al. | |
| 2003/0216488 | A1 | 11/2003 | Uchiyama et al. | |
| 2003/0220210 | A1 | 11/2003 | DuVal et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |
| 2004/0072720 | A1 | 4/2004 | Brain et al. | |
| 2004/0087477 | A1 | 5/2004 | Ness | |
| 2004/0106536 | A1 | 6/2004 | Mane et al. | |
| 2004/0167056 | A1 * | 8/2004 | Lentsch et al. | 510/504 |

(Continued)

FOREIGN PATENT DOCUMENTS

| | | |
|---|---|---|
| CA | 1312619 | 1/1993 |
| CS | 246532 | 3/1986 |

(Continued)

OTHER PUBLICATIONS

English language translation of CS 246532, listed as document B2 above.
English language abstract for DE 197 08 133, listed as document B3 above.
English language abstract for EP 0 284 036, listed as document B4 above.
English language abstract for WO 91/01295, listed as document B7 above.
English language abstract for WO 94/14935, listed as document B9 above.

(Continued)

*Primary Examiner* — Charles Boyer
(74) *Attorney, Agent, or Firm* — Law Office of: Michael A. Sanzo, LLC

(57) ABSTRACT

A particulate fabric softening composition, comprising one or more ethylenediamine fatty acid diamides and one or more quaternary ammonium salt fabric softeners, the composition having an exothermal transition at a temperature between 60 and 90° C. with an exothermal transition enthalpy of more than 5 J/g measured by DSC with a heating rate of 2° C./min, can be press shaped to multiple use, dryer added fabric softening articles having high initial surface hardness.

The fabric softening composition can be made by cooling a molten mixture comprising one or more ethylenediamine fatty acid diamides and one or more quaternary ammonium salt fabric softeners to a temperature of 40° C. or less at a high cooling rate.

25 Claims, 2 Drawing Sheets

(56) References Cited

U.S. PATENT DOCUMENTS

| | | | | |
|---|---|---|---|---|
| 2004/0204337 | A1 | 10/2004 | Corona et al. | |
| 2005/0014672 | A1 | 1/2005 | Arif | |
| 2005/0032671 | A1 | 2/2005 | Kvita et al. | |
| 2006/0089293 | A1 | 4/2006 | Frankenbach | |
| 2006/0094639 | A1 | 5/2006 | Martin et al. | |
| 2006/0142175 | A1 | 6/2006 | Haiss et al. | |
| 2006/0277689 | A1 | 12/2006 | Hubig et al. | |
| 2007/0054835 | A1 | 3/2007 | Corona et al. | |
| 2007/0066510 | A1 | 3/2007 | Tee et al. | |
| 2007/0219111 | A1 | 9/2007 | Ward et al. | |
| 2008/0242584 | A1 | 10/2008 | Wahl et al. | |
| 2008/0263780 | A1 | 10/2008 | Declercq et al. | |
| 2008/0289116 | A1 | 11/2008 | Young et al. | |
| 2009/0124533 | A1 | 5/2009 | Kottke et al. | |
| 2009/0181877 | A1 | 7/2009 | McGinnis et al. | |
| 2009/0203571 | A1 | 8/2009 | Nagy et al. | |
| 2011/0110993 | A1 | 5/2011 | Chieffi et al. | |
| 2011/0239377 | A1 | 10/2011 | Fossum et al. | |
| 2011/0239378 | A1 | 10/2011 | Fossum et al. | |
| 2011/0245138 | A1 | 10/2011 | Köhle et al. | |
| 2011/0245139 | A1 | 10/2011 | Köhle et al. | |
| 2011/0245140 | A1 | 10/2011 | Demeyere | |
| 2012/0021959 | A1* | 1/2012 | Morgan et al. | 510/103 |

FOREIGN PATENT DOCUMENTS

| | | | |
|---|---|---|---|
| DE | 24 30 140 | A1 | 2/1976 |
| DE | 34 02 146 | A1 | 7/1985 |
| DE | 36 08 093 | A1 | 9/1987 |
| DE | 197 08 133 | | 12/1997 |
| EP | 0 284 036 | | 9/1988 |
| EP | 0 293 955 | A2 | 12/1988 |
| EP | 0 302 567 | A2 | 2/1989 |
| EP | 0 421 146 | A2 | 9/1990 |
| EP | 0 829 531 | A1 | 3/1998 |
| EP | 1 018 541 | A1 | 7/2000 |
| EP | 1 323 817 | A1 | 12/2001 |
| EP | 1 393 706 | A1 | 3/2004 |
| EP | 1 840 197 | A1 | 2/2007 |
| GB | 2 007 734 | A | 5/1979 |
| GB | 2 039 556 | | 8/1980 |
| WO | WO 91/01295 | | 2/1991 |
| WO | WO 92/18593 | | 10/1992 |
| WO | WO 94/14935 | | 7/1994 |
| WO | WO 94/19439 | | 9/1994 |
| WO | WO 98/38277 | | 9/1998 |
| WO | WO 00/06678 | | 2/2000 |
| WO | WO 2005/085404 | A1 | 9/2005 |
| WO | WO 2007/026314 | A2 | 3/2007 |
| WO | WO 2007/125005 | | 11/2007 |
| WO | WO 2008/104509 | | 9/2008 |
| WO | WO 2009/018955 | A2 | 2/2009 |
| WO | WO 2011/120836 | A1 | 10/2011 |
| WO | WO 2011/123284 | A1 | 10/2011 |
| WO | WO 2011/123606 | A1 | 10/2011 |
| WO | WO 2011/123733 | A1 | 10/2011 |

OTHER PUBLICATIONS

English language abstract for WO 2007/125005, listed as document B10 above.

Ullman'S Encyclopedia of Industrial Chemistry; Wiley-VCH Verlag GmbH & Co. KGaA, Weinheim, vol. 14, Table 2, p. 77 (2012).

Preliminary Amendment filed for copending U.S. Appl. No. 13/643,486 on Oct. 25, 2012.

U.S. Appl. No. 13/603,000, filed Sep. 4, 2012, Nagy.

U.S. Appl. No. 13/643,486, filed Oct. 25, 2012, Köhle.

European Search Report for Application No. EP 11 17 1604.

English language abstract for DE 24 30 140, listed as document B1 above.

English language abstract for DE 34 02 146 Al, listed as document B2 above.

English language abstract for DE 36 08 093, listed as document B3 above.

English language abstract for EP 1 018 541, listed as document B8 above.

English language abstract for EP 0 421 146 A2, listed as document B6.

English language abstract for EP 1 323 817 Al, listed as document B9.

English language abstract for WO 2009/018955 A2, listed as document B17.

Second English language abstract for WO 2009/018955 A2, listed as document B17.

Price-Jones, et al., "*N,N'*-ethylenediyl-*bis*-alkanamides: Differential scanning calorimetry studies,"*J. Am. Oil Chem. Soc. 73*:311-319 (1996).

Product Advertisement for Tetranyl AO-1, http//kaochemicals-eu.com/213.html, downloaded Jul. 27, 2011.

* cited by examiner

PARTICULATE FABRIC SOFTENER COMPRISING ETHYLENEDIAMINE FATTY ACID AMIDES AND METHOD OF MAKING

CROSS REFERENCE TO RELATED APPLICATIONS

The present application claims the benefit of U.S. provisional application 61/359,660 filed on Jun. 29, 2010.

FIELD OF THE INVENTION

The invention relates to a particulate fabric softening composition which can be press shaped to multiple use, dryer added fabric softening articles having high initial surface hardness, and to a method of making such fabric softening composition.

BACKGROUND OF THE INVENTION

Dryer added fabric softening articles are a convenient way of softening fabrics. More convenient than single use articles, such as fabric softening dryer sheets, are multiple use articles, which are placed and kept inside the dryer for a multitude of drying cycles, releasing fabric softener to successive loads of the dryer.

Multiple use dryer added fabric softening articles comprising a quaternary ammonium salt fabric softener and a high melting carrier, such as an ethylenediamine fatty acid diamide, are known from U.S. 2003/0195130, U.S. 2004/0167056 and U.S. 2006/0277689. The dryer added fabric softening articles disclosed in these documents are made by melting and mixing the fabric softener and the carrier and solidifying the melt in the desired shape by methods such as injection molding or casting, as described in U.S. 2004/0167056 paragraph [0062]. One problem associated with dryer added fabric softening articles made this way is the staining of dark fabrics in the first cycles of using the article by excessive amounts of fabric softener, which can be traced back to an insufficient initial surface hardness of the article as discussed in U.S. 2006/0277689 paragraph [0028] and demonstrated in U.S. 2004/0167056 FIG. 6.

U.S. 2006/0277689 proposes to add from 5 to 30% by weight of an elasticity, shrinkage or surface hardness additive, but provides no teaching on which additive could provide an improved surface hardness. The only related example 3 shows a lowering of the surface hardness by the additive of sample 1.

U.S. 2007/0066510 teaches to use a fabric softener active consisting essentially of an ester quaternary ammonium compound free of any other quaternary ammonium compound to reduce the staining of dark fabrics. However, nothing is taught on how to obtain a high initial surface hardness for a dryer added fabric softening article comprising such an ester quaternary ammonium compound.

R. H. Pryce-Jones et al., J. Am. Oil Chem. Soc. 73 (1996) 311 to 319 discloses the results of DSC measurements on ethylenediamine fatty acid diamides. Materials crystallized from solution showed an endothermal solid phase transition at temperatures of 98 to 127° C. with a transition enthalpy of more than 30 J/g, but no exothermal solid phase transition. Endothermal solid phase transitions with a similar transition enthalpy were not observed for materials obtained by solidifying the melt during DSC at a rate of 10° C./min. The document contains no teachings on mixtures containing ethylenediamine fatty acid diamides and a fabric softener and the surface hardness of such mixtures.

There remains a need of providing a fabric softening composition that can be shaped to a dryer added fabric softening article having a high initial surface hardness.

SUMMARY OF THE INVENTION

The inventors of the present invention have now found that cooling a molten mixture comprising one or more ethylenediamine fatty acid diamides and one or more quaternary ammonium salt fabric softeners to a temperature of 40° C. or less at a high cooling rate surprisingly leads to a solid composition having an exothermal transition at a temperature between 60 and 90° C. with an exothermal transition enthalpy of more than 5 J/g measured by DSC (differential scanning calorimetry) with a heating rate of 2° C./min. Heating such a composition to a temperature which effects the exothermal transition unexpectedly leads to an increase in the surface hardness of the composition. This allows producing dryer added fabric softening articles having a high initial surface hardness by press shaping the particulate composition at a temperature sufficiently high to effect the exothermal transition.

DETAILED DESCRIPTION OF THE INVENTION

Figure 1:
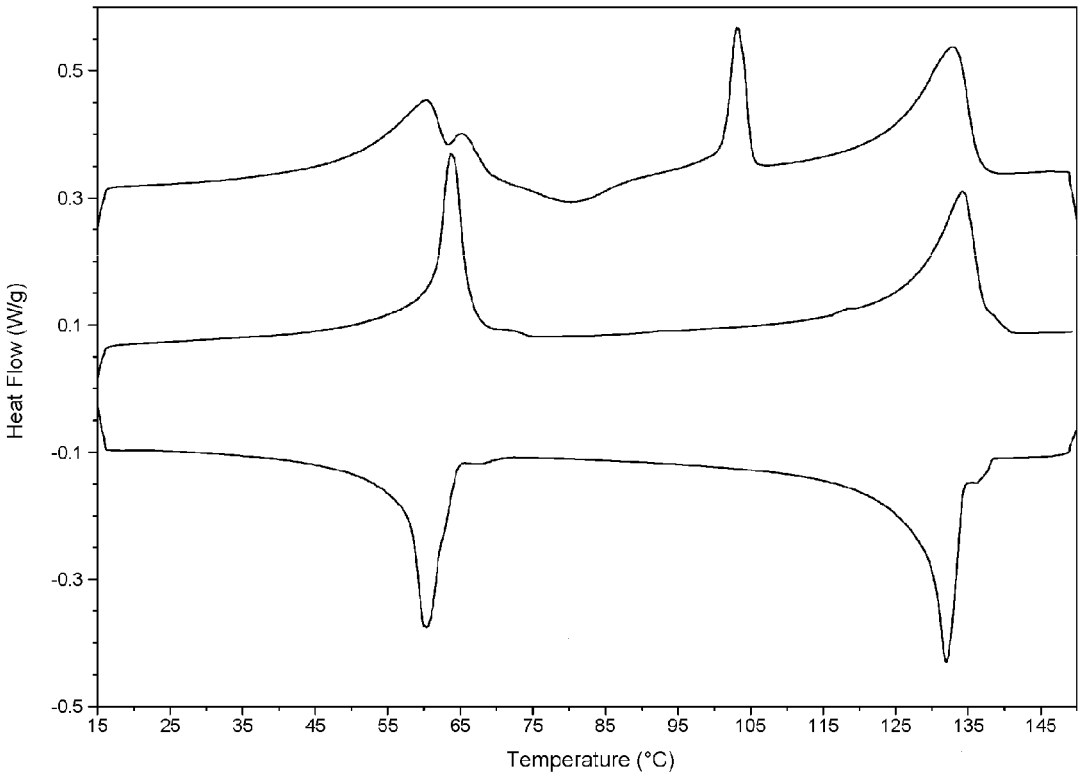
FIG. 1 shows DSC curves of the particulate fabric softening composition made in the examples by rapid cooling of the melt. DSC curves 1, 2 and 3 were measured subsequently by heating, cooling and reheating at heating and cooling rates of 2° C./min.

The particulate fabric softening composition of the invention comprises one or more ethylenediamine fatty acid diamides and one or more quaternary ammonium salt fabric softeners and has an exothermal transition at a temperature between 60 and 90° C. with an exothermal transition enthalpy of more than 5 J/g measured by differential scanning calorimetry (DSC) at a heating rate of 2° C./min.

The term particulate fabric softening composition as used in the context of this invention denotes a fabric softening composition in the form of a multitude of individual particles and excludes fabric softening articles in the form of individual pieces or blocks.

The particulate fabric softening composition may be composed of particles having any shape, such as spherical particles, irregular granules, elongated rods or flat or curved flakes. The particulate fabric softening composition is preferably composed of flakes, most preferably flat flakes.

The particulate fabric softening composition is preferrably composed of particles having an average thickness of at most 5 mm, more preferably in the range from 0.05 to 4 mm and most preferably in the range from 0.2 to 1.5 mm. The term thickness denotes the dimension of a particle along the smallest principle axis of inertia, i.e. for a spherical particle the term thickness denotes the particle diameter, for a rod-like particle the term thickness denotes the diameter of the rod and for a flake the term thickness denotes the thickness of the flake.

Ethylenediamine fatty acid diamides are compounds of formula $RC(O)NHCH_2CH_2NHC(O)R$ where RCOOH is a fatty acid. The ethylenediamine fatty acid diamides are preferably derived from fatty acids having from 14 to 22 carbon atoms and more preferably from fatty acids having from 14 to 18 carbon atoms. Preferably, the ethylenediamine fatty acid diamides are derived from fatty acids having an average chain length of from 16 to 18 carbon atoms, more preferably from fatty acids having an average chain length of from 16.5 to 17.8 carbon atoms. The ethylenediamine fatty acid diamides are preferably derived from fatty acids having an iodine value of less than 20 and more preferably from fatty acids having an iodine value of less than 5. Most preferred are mixtures of ethylenediamine bisstearamide and ethylenediamine bispalmitamide which are commercially available from Lonza under the trade name Acrawax® C. The selection of the fatty acid chain length and iodine value of the ethylenediamine fatty acid diamide allows to adjust the melting point of the fabric softening composition as required for a dryer added fabric softening article and to adjust the temperature of the exothermal transition of the composition to the process of press shaping the composition to a dryer added fabric softening article.

The particulate fabric softening composition of the invention preferably comprises 30 to 75% by weight ethylenediamine fatty acid diamides and 20 to 70% by weight quaternary ammonium salt fabric softeners. More preferably, the composition comprises 40 to 60% by weight ethylenediamine fatty acid diamides and 40 to 60% by weight quaternary ammonium salt fabric softeners and most preferably 45 to 53% by weight ethylenediamine fatty acid diamides and 45 to 53% by weight quaternary ammonium salt fabric softeners. Compositions having such contents of ethylenediamine fatty acid diamides and quaternary ammonium salt fabric softeners can be processed to dryer added fabric softening articles having an optimum combination of high softening efficiency and high surface hardness.

In a preferred embodiment of the invention, the fabric softening composition comprises quaternary ammonium salt fabric softeners of formula (I)

$$R^1_{4-m}N^+[(CH_2)_n\text{-}Q\text{—}R^2]_mX^- \quad (I)$$

wherein each $R^1$ is independently $C_1$-$C_6$ alkyl, $C_1$-$C_6$ hydroxyalkyl or benzyl;

$R^2$ is independently hydrogen, $C_{11}$-$C_{21}$ linear alkyl, $C_{11}$-$C_{21}$ branched alkyl, $C_{11}$-$C_{21}$ linear alkenyl or $C_{11}$-$C_{21}$ branched alkenyl, with the proviso that at least one of $R^2$ is not hydrogen;

Q is independently selected from the units having the formula —O—C(O)—, —C(O)O—, —$NR^3$—C(O)—, —C(O)—$NR^2$—, —O—C(O)—O—, —$CHR^4$—O—C(O)— or —$CH(OCOR^2)$—$CH_2$—O—C(O)—, wherein $R^3$ is hydrogen, methyl, ethyl, propyl or butyl and $R^4$ is hydrogen or methyl;

m is from 1 to 4;

n is from 1 to 4; and

X— is a softener compatible anion.

More preferred are quaternary ammonium salt fabric softeners of formula (I), where $R^1$ is methyl; Q is —O—C(O)— or —NH—C(O)—; m is 2 or 3; n is 2; and $X^-$ is chloride or methyl sulfate.

In another preferred embodiment of the invention, the fabric softening composition comprises fabric softeners of formulae (II) to (VII)

$$R^1N^+[CH_2CHR^4OH][CH_2CHR^4OC(O)R^2]_2X^- \quad (II)$$

$$R^1_2N^+[CH_2CHR^4OC(O)R^2]_2X^- \quad (III)$$

$$R^1N^+[CH_2CHR^4OH][CH_2CH_2NHC(O)R^2]_2X^- \quad (IV)$$

$$R^1_2(R^2CH_2)_2N+X^- \quad (V)$$

$$[R^2\text{—}C(O)NHCH_2CH_2]_2N^+R^1[CH_2CH_2OH]X^- \quad (VI)$$

(VII)

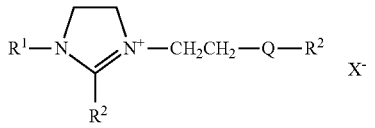

wherein each $R^1$ is independently $C_1$-$C_6$ alkyl, $C_1$-$C_6$ hydroxyalkyl or benzyl;

$R^2$ is independently $C_{11}$-$C_{21}$ linear alkyl, $C_{11}$-$C_{21}$ branched alkyl, $C_{11}$-$C_{21}$ linear alkenyl or $C_{11}$-$C_{21}$ branched alkenyl; $R^4$ is hydrogen or methyl;

Q is –O—C(O)— or —NH—C(O)—; and

X— is a softener compatible anion.

More preferred are quaternary ammonium salt fabric softeners of formulae (II) and (III), where $R^1$ is methyl; $R^2$ is $C_{15}$-$C_{17}$ linear alkyl or alkenyl with an iodine value of the corresponding fatty acid $R^2COOH$ of less than 20; Q is —O—C(O)—; and $X^-$ is chloride or methyl sulfate. Particularly preferred examples of such quaternary ammonium salt fabric softeners are the chloride or methyl sulfate salts of bis-(2-hydroxyethyl)-dimethylammonium fatty acid esters and tris-(2-hydroxyethyl)-methylammonium fatty acid esters having a molar ratio of fatty acid moieties to amine moieties of from 1.5 to 2.0. Such quaternary ammonium salt fabric softeners provide compositions having high softening efficiency and good biodegradability.

Also preferred are such quaternary ammonium salt fabric softeners where $R^4$ is methyl, as they provide compositions with reduced hydrolysis of the fatty acid ester at the conditions of use of a dryer added fabric softening article. Particularly preferred examples of such quaternary ammonium salt fabric softeners are the chloride or methyl sulfate salts of bis-(2-hydroxypropyl)-dimethylammonium fatty acid esters having a molar ratio of fatty acid moieties to amine moieties of from 1.5 to 1.99.

The particulate fabric softening composition of the invention may further comprise up to 10% by weight perfume and preferably comprise from 2 to 5% by weight perfume. Suitable are all perfumes known from the prior art for use in dryer added fabric softening articles and in particular the low volatile perfume compositions, cyclodextrin-perfume-complexes and microencapsulated perfumes disclosed in WO 2005/085404 page 5, line 26 to page 13, line 26, which is hereby incorporated by reference.

The particulate fabric softening composition of the invention may further comprise up to 10% by weight of an alcohol solvent, preferably a $C_3$-$C_9$ diol or polyol solvent. Preferred diol or polyol solvents are 1,2-propanediol, 1,3-propanediol, glycerol, dipropylene glycol, diglycerol, triglycerol and mixtures thereof. The most preferred solvent is dipropylene glycol. The addition of such solvents provides compositions that can be press shaped to dryer added fabric softening articles which show reduced shape deformation and cracking caused by temperature changes.

The particulate fabric softening composition of the invention undergoes an exothermal transition at a temperature between 60 and 90° C. measured by differential scanning calorimetry (DSC) at a heating rate of 2° C./min. The exothermal transition enthalpy of the composition measured at this heating rate is more than 5 J/g, preferably more than 7 J/g and most preferably more than 10 J/g. The exothermal transition enthalpy of the composition is usually less than 50 J/g and preferably not more than 30 J/g. Applicants have found that compositions having such an exothermal transition can be made by rapidly cooling a molten mixture comprising ethylenediamine fatty acid diamides and quaternary ammonium salt fabric softeners to a temperature of 40° C. or less, preferably at a cooling rate of more than 10° C./min. Applicants have also found that slow cooling of the same molten mixture leads to a solid composition which does not undergo an exothermal transition in the solid state.

Applicants have further found that heating a composition having an exothermal transition at a temperature between 60 and 90° C. to a temperature, which effects the exothermal transition but is lower than the temperature of the first endothermal transition of the composition at higher temperatures, unexpectedly leads to an increase in the surface hardness of the composition. Similar heating of a mixture obtained by slow cooling of a melt and not showing an exothermal transition does not lead to an increase in surface hardness.

Not wishing to be bound by theory, applicants believe that rapid cooling of the molten mixture leads to a metastable solid mixture, which by heating to a temperature which effects the exothermal transition leads to the formation of a solid phase rich in fatty acid diamides having high ordering of the fatty acid chains and providing high surface hardness to the solid composition. Surprisingly, slow cooling of the molten mixture does not lead to the highly ordered phase, which is contrary to general knowledge that slow cooling of melts leads to the thermodynamically more stable highly ordered phases and rapid cooling leads to less ordered solid phases. The formation of the solid phase rich in fatty acid diamides having high ordering of the fatty acid chains can be inferred from DSC measurements showing an endothermal solid phase transition at a temperature similar to the ordered to disordered solid phase transitions reported in R. H. Pryce-Jones et al., J. Am. Oil Chem. Soc. 73 (1996) 311 to 319 for pure fatty acid diamides.

FIG. 1 shows DSC curves of a particulate fabric softening composition made by rapid cooling of a molten mixture of Acrawax® C, tris-(2-hydroxyethyl)-methylammonium tallow fatty acid diester and perfume. DSC curves 1, 2 and 3 were measured subsequently by heating, cooling and reheating at heating and cooling rates of 2° C./min. The first heating curve 1 shows an exothermal transition, which is characteristic for the particulate fabric softening compositions of the invention, in the temperature range of 75 to 90° C. Curve 1 also shows endothermal transitions at 45 to 70° C. due to partial melting of the quaternary ammonium salt, at 100 to 105° C. due to the ordered to disordered transition of the fatty acid diamide solid phase and at 125 to 135° C. due to melting of the fatty acid diamide, which leads to melting of the composition. The cooling curve 2 shows only transitions for the solidification of the fatty acid diamide and the quaternary ammonium salt, but no disordered to ordered transition of the fatty acid diamide solid phase. Cooling in the DSC apparatus provides a solid fabric softening composition made by slow cooling at a cooling rate of 2° C./min. The second heating curve 3 obtained with this composition shows only the endothermal transitions at 60 to 65° C. due to partial melting of the quaternary ammonium salt and at 125 to 135° C. due to melting of the fatty acid diamide, but no exothermal transition and no endothermal ordered to disordered transition of the fatty acid diamide solid phase.

Figure 2:
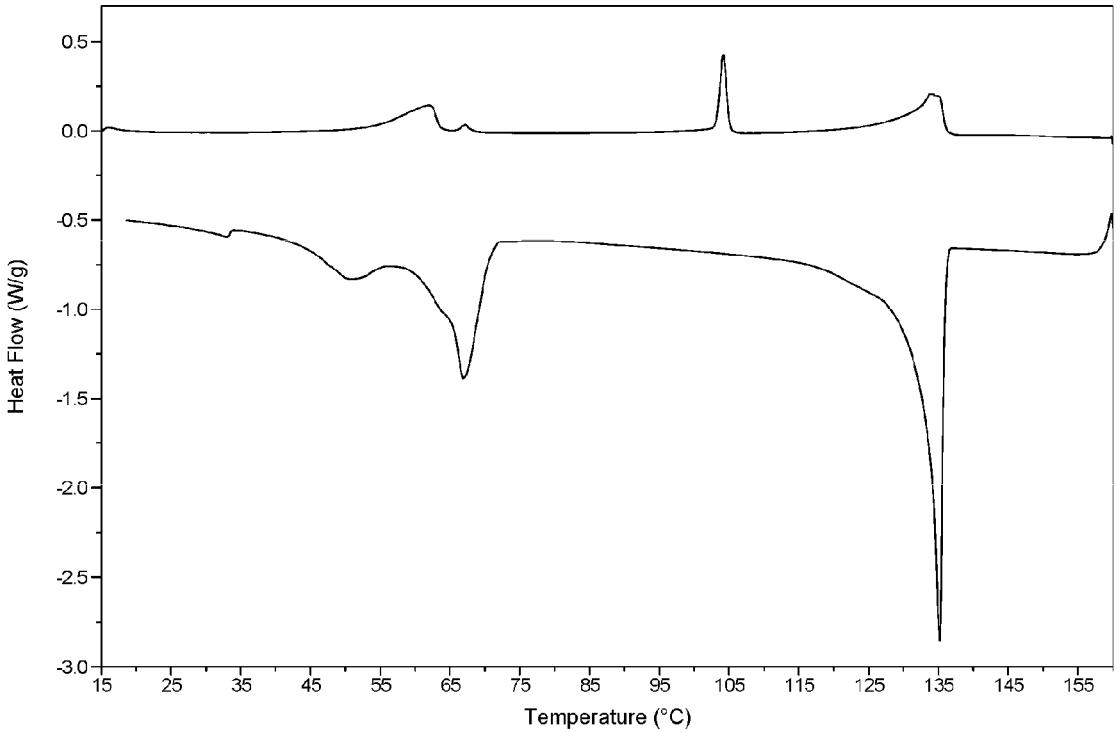
FIG. 2 shows DSC curves of the same particulate fabric softening composition after tempering for 2 h at 70° C. DSC curves 4 and 5 were measured subsequently by heating and cooling at heating and cooling rates of 2° C./min.

FIG. 2 shows DSC curves of the same particulate fabric softening composition as in FIG. 1, but after tempering the composition for 2 h at a temperature of 70° C. The heating curve 4 of the tempered composition no longer shows an exothermal transition, but it shows the ordered to disordered transition of the fatty acid diamide solid phase at 102 to 105° C. The cooling curve 5 again shows only transitions for the solidification of the fatty acid diamide and the quaternary ammonium salt, but no disordered to ordered transition of the fatty acid diamide solid phase.

The invention is therefore also directed to a method for making a particulate fabric softening composition according to the invention, comprising cooling a molten mixture comprising one or more ethylenediamine fatty acid diamides and one or more quaternary ammonium salt fabric softeners to a temperature of 40° C. or less at a high cooling rate. The cooling rate is more than 10° C./min, preferably more than 20° C./min and most preferably more than 50° C./min. The molten mixture is preferably cooled to a temperature below the solidification temperature of said mixture at a cooling rate of at least 50° C./min, more preferably at a cooling rate of more than 100° C./min and most preferably at a cooling rate of more than 200° C./min. Rapid cooling is essential for obtaining a solid fabric softening composition having an exothermal transition at a temperature between 60 and 90° C.

Cooling the molten mixture at a cooling rate of more than 10° C./min can be achieved by cooling with a gas, for example by introducing molten mixture into a fluidized bed operated with a cooling gas, such as cold air or cold nitrogen gas, as the fluidizing medium. Alternatively, cooling can be achieved by cooling with a liquid, for example by introducing molten mixture in a prilling process into a liquid, in which the fatty acid diamides and the quaternary ammonium salt fabric softeners are insoluble or poorly soluble. Preferably, cooling is performed by contact with a cooled surface, more preferably by contact with a cooled metal surface. In a particularly preferred embodiment, the molten mixture is cooled on a continuous belt flaker. The molten mixture is preferably applied to the belt of the belt flaker at a rate so as to provide a layer of a thickness of less than 4 mm, preferably less than 1 mm. Cooling on a continuous belt flaker allows reproducible cooling of the molten mixture at high throughput and provides a flaked product that can be processed by press shaping to multiple use dryer added fabric softening articles without requiring any intermediate treatment.

In the method of the invention, the same ethylenediamine fatty acid diamides, quaternary ammonium salt fabric softeners, perfumes and solvents as disclosed above for the particulate fabric softening composition of the invention are preferred as starting materials for providing the molten mixture.

In the method of the invention, the molten mixture may be provided by melting a mixture of ethylenediamine fatty acid diamides and quaternary ammonium salt fabric softeners, optionally comprising perfumes and/or solvents. However, it is preferred to provide the molten mixture by combining a melt of ethylenediamine fatty acid diamides with a melt of quaternary ammonium salt fabric softeners heated to a temperature above the melting point of said ethylenediamine fatty acid diamides, optionally adding a perfume and/or a solvent to the starting melts or preferably to the resulting mixture. The liquid resulting from combining a melt of ethylenediamine fatty acid diamides, a melt of quaternary ammonium salt fabric softeners heated to a temperature above the melting point of said ethylenediamine fatty acid diamides, and optionally a perfume and/or a solvent is preferably passed through a mixer, which is most preferably a static mixer, to obtain a homogenous molten mixture before cooling is carried out.

When the quaternary ammonium salt fabric softeners are selected from the group of compounds of formulae (II) and (III) where Q is —O—C(O)—, the molten mixture is preferably provided by combining a melt of ethylenediamine fatty acid diamides, a melt of quaternary ammonium salt fabric softeners heated to a temperature above the melting point of said ethylenediamine fatty acid diamides, and optionally a perfume and/or solvent, and the melt of quaternary ammonium salt fabric softeners is provided by melting the quaternary ammonium salt fabric softeners at a temperature of no more than 90° C. and heating the resulting melt less than 10 min, preferably less than 1 min, before combining it with the melt of ethylenediamine fatty acid diamides to a temperature high enough to provide a temperature of the combined melts that is higher than the melting temperature of the ethylenediamine fatty acid diamides. This embodiment prevents the formation of byproducts by thermal degradation of the quaternary ammonium salt fabric softeners and provides fabric softening compositions of the invention with highly reproducible composition, no discoloration and low byproduct content.

The invention is illustrated by the following examples, which are however not intended to limit the scope of the invention in any way.

EXAMPLES

A melt of tris-(2-hydroxyethyl)-methylammonium tallow fatty acid diester was provided in a first stirred tank at 82° C. and a melt of Acrawax® C (mixture of ethylenediamine bis-stearamide and ethylenediamine bispalmitamide) was provided in a second stirred tank at 186° C. Melt taken from the first tank was heated to 110° C. by passing it through a steam heated Kenics® static mixer, the resulting stream of heated melt was combined with a stream of melt from the second stirred tank and a stream of liquid perfume in a weight ratio of 47:50:3 and thereafter passed to a steam heated Kenics® static mixer to provide a molten composition at a temperature of 152° C. This molten composition was flaked on a Sandvik continuous belt flaker, equipped with a water cooled steel belt and a flake breaker, cooling the mixture to below 40° C. in less than 25 s, to provide flakes with a thickness of 0.25 to 1 mm and a diameter of 0.5 to 2 cm.

A sample of the flakes was heat treated for 2 h at 70° C.

DSC measurements were carried out on a TA Instruments Q1000 DSC instrument with the flakes as prepared and the heat treated flakes, using samples of approximately 4 mg in aluminum cups and heating and cooling rates of 2° C./min. FIG. 1 shows the DSC curves of the flakes as prepared in curves 1, 2 and 3 for heating, cooling and reheating. Curves 1, 2 and 3 have been offset by 0.325, −0.1 and 0.075 W/g for clarity. FIG. 2 shows the DSC curves of the heat treated flakes in curves 4 and 5 for heating and cooling. Curve 5 has been offset by −0.5 W/g for clarity. Integration of the exothermal peak in curve 1 of FIG. 1 gives an exothermal transition enthalpy of 14 J/g.

The surface hardness of the flakes was analyzed by scratching flakes on both sides with a Taber® 710 Multi-Finger Scratch Tester with a scratch tip (hemisphere with 1 mm diameter), a load of 2 N and a velocity of 100 mm/s and determining scratch width and depth with a confocal laser scanning microscope. Table 1 shows the results obtained for flakes before and after heat treatment.

For comparison, a sample of the flakes was melted in a petri dish on a hot plate, allowed to cool to ambient temperature over 4 h on the switched off hot plate and then analyzed for surface hardness before and after a heat treatment for 16 h at 70° C. The results are also shown in Table 1.

The results of table 1 demonstrate that the particulate fabric softening composition of the invention, made by rapid cooling of the molten mixture, will provide high initial surface hardness for a dryer added fabric softening article, made by shaping such a composition, at the conditions of use of such article in a dryer, such conditions being similar to the heat treatment step of the example. This is in contrast to the prior art dryer added fabric softening articles made by slow cooling of the molten mixture in a casting process, which have much lower initial surface hardness at the conditions of use, as demonstrated by the comparative example.

TABLE 1

Results of scratch tests

| Sample | Scratch width in mm | Scratch depth in μm |
|---|---|---|
| Flakes from rapid cooling, before heat treatment | | |
| upper side | 0.6 | 90 |
| lower side | 0.4 | 50 |
| Flakes from rapid cooling, after heat treatment | | |
| upper side | 0.3 | 20 |
| lower side | 0.2 | 20 |
| Sample from slowly cooled melt*, before heat treatment | 0.4 | 35 |
| Sample from slowly cooled melt*, after heat treatment | 0.6 | 100 |

*Not according to the invention

What is claimed is:

1. A particulate fabric softening composition, comprising one or more ethylenediamine fatty acid diamides and one or more quaternary ammonium salt fabric softeners, the composition having an exothermal transition at a temperature between 60 and 90° C. with an exothermal transition enthalpy of more than 5 J/g measured by DSC at a heating rate of 2° C./min; wherein said quaternary ammonium salt fabric softeners are selected from the group consisting of compounds of formulae (I)-(V):

$$\text{(I)}\ R^1_{4-m}N^+[(CH_2)_n\text{-}Q\text{—}R^2]_mX^- \quad \text{(I)}$$

$$\text{(II)}\ R^1N^+[CH_2CHR^4OH][CH_2CHR^4OC(O)R^2]_2X^- \quad \text{(II)}$$

$$\text{(III)}\ R^1{}_2N^+[CH_2CHR^4OC(O)R^2]_2X^- \quad \text{(III)}$$

$$\text{(IV)}\ R^1N^+[CH_2CHR^4OH][CH_2CH_2NHC(O)R^2]_2X^- \quad \text{(IV)}$$

$$\text{(V)}\ [R^2\text{—}C(O)NHCH_2CH_2]_2N^+R^1[CH_2CH_2OH]X^- \quad \text{(V)}$$

wherein: when said quaternary ammonium salt fabric softeners are compounds of formula I:

each $R^1$ is independently $C_1$-$C_6$ alkyl, $C_1$-$C_6$ hydroxyalkyl or benzyl;

$R^2$ is independently hydrogen, $C_{11}$-$C_{21}$ linear alkyl, $C_{11}$-$C_{21}$ branched alkyl, $C_{11}$-$C_{21}$ linear alkenyl or $C_{11}$-$C_{21}$ branched alkenyl, with the proviso that at least one of $R^2$ is not hydrogen;

Q is independently selected from the units having the formula —O—C(O)—, —C(O)O—, —$NR^3$—C(O)—, —C(O)—$NR^3$—, —O—C(O)—O—, —$CHR^4$—O—C(O)— or —$CH(OCOR^2)$—$CH_2$—O—C(O), wherein $R^3$ is hydrogen, methyl, ethyl, propyl or butyl and $R^4$ is hydrogen or methyl;

m is from 1 to 4;

n is from 1 to 4; and $X^-$ is a softener compatible anion; and when said quaternary ammonium salt fabric softeners are selected from the group consisting of compounds of formulae (II)-(V):

each $R^1$ is independently $C_1$—$C_6$ alkyl, $C_1$—$C_6$ hydroxyalkyl or benzyl;

$R^2$ is independently $C_{11}$—$C_{21}$ linear alkyl, $C_{11}$—$C_{21}$ branched alkyl, $C_{11}$—$C_{21}$ linear alkenyl or $C_{11}$—$C_{21}$ branched alkenyl;

$R^4$ is hydrogen or methyl; and $X^-$ is softener compatible anion.

2. The particulate fabric softening composition of claim 1, comprising 30 to 75% by weight ethylenediamine fatty acid diamides and 20 to 70% by weight quaternary ammonium salt fabric softeners.

3. The particulate fabric softening composition of claim 1, further comprising up to 10% by weight of a $C_3$-$C_9$ diol or polyol solvent.

4. The particulate fabric softening composition of claim 3, wherein the diol or polyol solvent is selected from the group consisting of 1,2-propanediol, 1,3-propanediol, glycerol, dipropylene glycol, diglycerol, triglycerol and mixtures thereof.

5. The particulate fabric softening composition of claim 1, wherein the ethylenediamine fatty acid diamides are derived from fatty acids having from 14 to 22 carbon atoms.

6. The particulate fabric softening composition of claim 1, wherein the ethylenediamine fatty acid diamides are derived from fatty acids having an iodine value of less than 20.

7. The particulate fabric softening composition of claim 1, comprising a quaternary ammonium salt fabric softener of formula (I) and wherein, in formula (I), $R^1$ is methyl; Q is —O—C(O)— or —NH—C(O)—; m is 2 or 3; n is 2; and $X^-$ is chloride or methyl sulfate.

8. The particulate fabric softening composition of claim 1, wherein the quaternary ammonium salt fabric softeners are selected from the group of compounds of formulae (II) and (III); $R^1$ is methyl; $R^2$ is $C_{15}$-$C_{17}$ linear alkyl or alkenyl with an iodine value of the corresponding fatty acid $R^2COOH$ of less than 20; and $X^-$is chloride or methyl sulfate.

9. A method for making a particulate fabric softening composition according to claim 1, comprising cooling a molten mixture comprising one or more ethylenediamine fatty acid diamides and one or more quaternary ammonium salt fabric softeners to a temperature of 40° C. or less at a cooling rate of more than 10° C./min;

wherein the quaternary ammonium salt fabric softeners are selected from the group consisting of compounds of formulae (I)-(V):

$$\text{(I)}\ R^1_{4-m}N^+[(CH_2)_n\text{-}Q\text{—}R^2]_mX^- \quad \text{(I)}$$

$$\text{(II)}\ R^1N^+[CH_2CHR^4OH][CH_2CHR^4OC(O)R^2]_2X^- \quad \text{(II)}$$

$$\text{(III)}\ R^1_2N^+[CH_2CHR^4OC(O)R^2]_2X^- \quad \text{(III)}$$

$$\text{(IV)}\ R^1N^+[CH_2CHR^4OH][CH_2CH_2NHC(O)R^2]_2X^- \quad \text{(IV)}$$

$$\text{(V)}\ [R^2\text{—}C(O)NHCH_2CH_2]_2N^+R^1[CH_2CH_2OH]X^- \quad \text{(V)}$$

wherein: when said quaternary ammonium salt fabric softeners are compounds of formula I:

each $R^1$ is independently $C_1$-$C_6$ alkyl, $C_1$-$C_6$ hydroxyalkyl or benzyl;

$R^2$ is independently hydrogen, $C_{11}$-$C_{21}$ linear alkyl, $C_{11}$-$C_{21}$ branched alkyl, $C_{11}$-$C_{21}$ linear alkenyl or $C_{11}$-$C_{21}$ branched alkenyl, with the proviso that at least one of $R^2$ is not hydrogen;

Q is independently selected from units having the formula —O—C(O)—, —C(O)O—, —$NR^3$—C(O)—, —C(O)—$NR^3$—, —O—C(O)—O—, —$CHR^4$—O—C(O)— or —CH($OCOR^2$)—$CH_2$—O—C(O)—, wherein $R^3$ is hydrogen, methyl, ethyl, propyl or butyl and $R^4$ is hydrogen or methyl;

m is from 1 to 4;

n is from 1 to 4; and $X^-$ is a softener compatible anion; and when said quaternary ammonium salt fabric softeners are selected from the group consisting of compounds of formulae (II)-(V):

each $R^1$ is independently $C_{11}$—$C_6$ alkyl, $C_1$—$C_6$ hydroxyalkyl or benzyl;

$R^2$ is independently $C_{11}$—$C_{21}$ linear alkyl, $C_{11}$—$C_{21}$ branched alkyl, $C_{11}$—$C_{21}$ linear alkenyl or $C_{11}$-$C_{21}$ branched alkenyl;

$R^4$ is hydrogen or methyl; and $X^-$ is a softener compatible anion.

10. The method of claim 9, wherein the molten mixture is cooled to a temperature below the solidification temperature of said mixture at a cooling rate of at least 50° C./min.

11. The method of claim 9, wherein the molten mixture comprises 30 to 75% by weight ethylenediamine fatty acid diamides and 20 to 70% by weight quaternary ammonium salt fabric softeners.

12. The method of claim 9, wherein the molten mixture is made by combining a melt of ethylenediamine fatty acid diamides, a melt of quaternary ammonium salt fabric softeners heated to a temperature above the melting point of said ethylenediamine fatty acid diamides, and optionally a perfume, and passing the resulting liquid mixture through a mixer.

13. The method of claim 9, wherein the ethylenediamine fatty acid diamides are derived from fatty acids having from 14 to 22 carbon atoms.

14. The method of claim 9, wherein the ethylenediamine fatty acid diamides are derived from fatty acids having an iodine value of less than 20.

15. The method of claim 9, wherein the quaternary ammonium salt fabric softeners are selected from the group of compounds of formulae (II) and (III); $R^1$ is methyl; $R^2$ is $C_{15}$-$C_{17}$ linear alkyl or alkenyl with an iodine value of the corresponding fatty acid $R^2COOH$ of less than 20; and $X^-$ is chloride or methyl sulfate.

16. The method of claim 9, wherein the quaternary ammonium salt fabric softeners are selected from the group of compounds of formulae (II) and (III) where the molten mixture is made by combining a melt of ethylenediamine fatty acid diamides, a melt of quaternary ammonium salt fabric softeners and optionally a perfume; and said melt of quaternary ammonium salt fabric softeners is provided by melting said quaternary ammonium salt fabric softeners at a temperature of no more than 90° C. and heating the resulting melt less than 10 min before combining it with said melt of ethylenediamine fatty acid diamides to a temperature high enough to provide a temperature of the combined melts that is higher than the melting temperature of the ethylenediamine fatty acid diamides.

17. The particulate fabric softening composition of claim 1, further comprising up to 10% by weight perfume.

18. The particulate fabric softening composition of claim 1, wherein the ethylenediamine fatty acid diamides are derived from fatty acids having an average chain length of from 16 to 18 carbon atoms.

19. The method of claim 9, wherein the molten mixture is cooled by contact with a cooled surface.

20. The method of claim 9, wherein the molten mixture is cooled on a continuous belt flaker.

21. The method of claim 11, wherein the molten mixture further comprises up to 10% by weight perfume.

22. The method of claim 11, wherein the molten mixture further comprises up to 10 by weight of a C3-C9 diol or polyol solvent.

23. The method of claim 22, wherein the diol or polyol solvent is selected from the group consisting of 1,2-propanediol, 1,3-propanediol, glycerol, dipropylene glycol, diglycerol, triglycerol and mixtures thereof.

24. The method of claim 12, wherein the mixer is a static mixer.

25. The method of claim 9, wherein the ethylenediamine fatty acid diamides are derived from fatty acids having an average chain length of from 16 to 18 carbon atoms.

* * * * *